US007478806B2

(12) United States Patent
Buck et al.

(10) Patent No.: US 7,478,806 B2
(45) Date of Patent: Jan. 20, 2009

(54) APPARATUS FOR CONVEYING A SHEET THROUGH A PRINTING MACHINE

(75) Inventors: Helmut Buck, Schriesheim (DE); Veronika Himmelsbach, Heidelberg (DE); Goetz Schnell, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 318 days.

(21) Appl. No.: 11/348,771

(22) Filed: Feb. 7, 2006

(65) Prior Publication Data

US 2006/0177256 A1 Aug. 10, 2006

(30) Foreign Application Priority Data

Feb. 7, 2005 (DE) ..... 10 2005 005 571

(51) Int. Cl.
*B65H 29/04* (2006.01)
*B41F 13/24* (2006.01)

(52) U.S. Cl. ..... 271/204; 271/276; 271/82; 101/232; 101/407.1; 101/408

(58) Field of Classification Search ..... 271/227, 271/258.01, 265.01, 259, 261, 204, 206, 271/82; 101/232, 407.1, 408, 409
See application file for complete search history.

(56) References Cited

U.S. PATENT DOCUMENTS

| | | | | |
|---|---|---|---|---|
| 4,127,265 | A | 11/1978 | Wirz et al. | |
| 5,156,090 | A * | 10/1992 | Wirz | 101/142 |
| 5,186,105 | A * | 2/1993 | Emrich et al. | 101/217 |
| 5,231,927 | A | 8/1993 | Pfisterer et al. | |
| 5,333,547 | A * | 8/1994 | Pfisterer et al. | 101/409 |
| 5,335,597 | A * | 8/1994 | Helmstadter | 101/485 |
| 5,582,400 | A * | 12/1996 | Seydel | 271/176 |
| 5,659,178 | A * | 8/1997 | Bucher et al. | 250/559.3 |
| 5,944,431 | A | 8/1999 | Becker et al. | |
| 6,047,961 | A | 4/2000 | Becker et al. | |
| 6,715,751 | B2 * | 4/2004 | Henn | 271/82 |
| 7,270,325 | B2 * | 9/2007 | Sano et al. | 271/262 |
| 2002/0063381 | A1 | 5/2002 | Henn | |
| 2002/0096824 | A1 | 7/2002 | Forch et al. | |
| 2005/0189709 | A1 * | 9/2005 | Bokelman et al. | 271/265.01 |
| 2007/0006754 | A1 * | 1/2007 | Eckart et al. | 101/232 |

FOREIGN PATENT DOCUMENTS

| | | |
|---|---|---|
| DE | GM 77 00 430 U1 | 5/1978 |
| DE | 233 653 A1 | 3/1986 |
| DE | 41 13 478 A1 | 10/1992 |

(Continued)

*Primary Examiner*—Patrick H Mackey
*Assistant Examiner*—Luis Gonzalez
(74) *Attorney, Agent, or Firm*—Laurence A. Greenberg; Werner H. Stemer; Ralph E. Locher

(57) ABSTRACT

An apparatus for conveying sheets through a printing machine allows continuous monitoring of the position of a sheet with regard to a guide element over a long time period. There is provided a circulating conveyor element with grippers in which the sheet is held at a leading edge. A device for setting the position of the sheet can adjust the position with regard to a desired position. A measuring configuration measures the position and the presence of the sheet. A control device is connected to the device for setting the position and to the measuring configuration. The measuring configuration is mounted so as to circulate with the conveyor element.

8 Claims, 2 Drawing Sheets

FOREIGN PATENT DOCUMENTS

| | | | |
|---|---|---|---|
| DE | 43 23 091 | A1 | 1/1995 |
| DE | 197 07 657 | A1 | 9/1998 |
| DE | 197 07 660 | A1 | 9/1998 |
| DE | 197 30 042 | A1 | 1/1999 |
| DE | 198 53 417 | A1 | 6/1999 |
| DE | 198 10 239 | A1 | 7/1999 |
| DE | 103 12 162 | A1 | 10/2004 |
| DE | 103 21 360 | B3 | 10/2004 |

* cited by examiner

APPARATUS FOR CONVEYING A SHEET THROUGH A PRINTING MACHINE

BACKGROUND OF THE INVENTION

Field of the Invention

The invention relates to an apparatus for conveying a sheet through a printing machine. The conveying system includes a circulating conveyor element with grippers, in which the sheet is held at its leading edge. The position of the sheet with regard to a desired position may be adjusted with a setting device. The position of the sheet is measured with a measuring configuration. A control device is connected to the setting device and to the measuring configuration.

U.S. Pat. No. 5,231,927 and its counterpart German published patent application DE 41 13 478 A1 disclose a sheet control apparatus for cylinders that transfer sheets, wherein sheet control apparatus three sensing elements are arranged on the cylinder in the region of a gripper edge for sensing a sheet leading edge. In this way, the position of the sheet on the circumferential surface of the cylinder can be controlled. The signals of the sensing elements can be fed to a stationary evaluating apparatus by way of a rotary transmitter.

In an assembly for controlling the position of a sheet edge on a transport drum in accordance with German published patent application DE 43 23 091 A1, a capacitive edge sensor and an inductive rotary transmitter are provided in the high frequency range. The capacitance of the sensor and the inductance of a coupling coil form a passive tuned circuit which can be coupled to an active tuned circuit of a stationary evaluating apparatus.

German published patent application DE 198 53 417 A1 shows a turner drum having tongs-type grippers, wherein a missing sheet sensor is arranged at the leading edge of a sheet in the manner of a tongs-like gripper. The sensor changes its output signal if a sheet is lost from the tongs-type grippers.

U.S. Pat. No. 6,047,961 and its counterpart German published patent application DE 197 07 657 A1 describe a sheet sensor in the form of a light barrier. A light beam is directed outward from a location in the interior of a sheet transport drum transversely with respect to the axis of the drum. The light beam strikes a sheet through an opening in the drum wall, if the sheet is held in grippers and has a minimum length.

A sheet sensor configuration in accordance with U.S. Pat. No. 5,944,431 and its counterpart German published patent application DE 197 07 660 A1 is configured as a light curtain. Light transmitters which emit parallel light beams and associated receivers are arranged on both sides of a conveying path in the sheet turning region between a storage drum and a turner drum. The light curtain searches for the presence of a side edge of a fluttering sheet at a defined instant in time.

German published patent application DD 233653 A1 and German patent DE 103 21 360 B3 describe configurations for measuring the pressure between cylinders, wherein a sensor film is arranged under a cover or a sensor is arranged in a recess in the circumferential surface of one of the cylinders. If a printing material is guided in the gap between the cylinders, the pressure changes compared with the state without a printing material, which can be detected by way of a change in the output signal of the sensor.

The solutions according to the prior art are configured only for the purpose of detecting the presence or the position of a sheet on a cylinder. Conveying apparatuses for sheets which are guided by blast air and/or vacuum in a manner which is held at the leading edge but otherwise free require the distance with respect to sheet guiding elements to be measured.

German patent DE 197 30 042 C2 discloses an apparatus for controlling sheet guiding, wherein the actual position of a sheet is sensed with a stationary, contactless sensor. After a comparison with a setpoint position, actuators of a blast air and/or vacuum device are set in such a way that the sheet rests reliably on the circumferential surface of a cylinder.

German published patent application DE 198 10 239 A1 discloses a camera monitoring means for a sheet run. A stationary camera produces an image of the contour of a sheet during the conveyance. The actual contour of the sheet is determined from image processing. Deviations from the ideal case are determined with a setpoint/actual value contour comparison. Manipulated variables for actuating elements are determined from the comparison data, which manipulated variables reliably prevent a sheet from coming into contact with a guide plate or a fan path.

Solutions that employ a stationary sheet sensor have the disadvantage that the measured values are available only in a small time range or within a rotational angle range of a cylinder or a drum.

SUMMARY OF THE INVENTION

It is accordingly an object of the invention to provide a device for conveying a sheet through a press which overcomes the above-mentioned disadvantages of the heretofore-known devices and methods of this general type and which enables continuous monitoring of the position of a sheet with regard to a guide element over a large time period.

With the foregoing and other objects in view there is provided, in accordance with the invention, an apparatus for conveying a sheet through a printing machine, comprising:

- a circulating conveyor element having grippers for holding the sheet at a leading edge thereof;
- a device for setting a position of the sheet with regard to a desired position;
- a measuring configuration disposed to circulate with the circulating conveyor element for measuring a position of the sheet; and
- a control device connected to the device for setting the position and to the measuring configuration.

In accordance with an added feature of the invention, the measuring configuration comprises a light source disposed to direct light beams onto the sheet, and a light receiver for receiving light beams reflected from the sheet.

In accordance with an additional feature of the invention, the measuring configuration comprises an ultrasound source disposed to direct ultrasound waves onto the sheet, and an ultrasound receiver for receiving ultrasound waves reflected from the sheet.

In accordance with another feature of the invention, the control device is a stationary control device and the measuring configuration is connected wirelessly to the stationary control device.

In accordance with a further feature of the invention, the conveyor element is a gripper fastened to a rotatable drum, and the measuring configuration is directed onto the sheet at a location following the gripper in a conveying direction. In the preferred embodiment, the measuring configuration is configured to measure a distance of the sheet from a surface of the rotatable drum.

In accordance with an alternative embodiment of the invention, the conveyor element is fastened to the rotatable drum and the measuring configuration is configured to measure the position of the sheet on the surface of the rotating drum.

In yet another embodiment of the invention, the measuring configuration includes a plurality of sensors disposed at different positions of the rotating drum.

The position-adjusting apparatus for setting the position of the sheet may be a blast air apparatus. In addition, or in the alternative, there is provided a device for moving the grippers in a circumferential direction of the drum.

In accordance with the invention, at least one sensor is arranged on a cylinder or a drum or on a circulating conveyor element. The position of a sheet in relation to the conveyor element or in relation to a stationary guide element can be measured repeatedly with the sensor over a relatively long time independently of the conveying speed. Optical sensors or ultrasound sensors which are configured for distance measurement are particularly suitable. If a plurality of sensors are arranged, the position and inclination of a sheet can be detected three-dimensionally. The measured signals can be transmitted from the sensor to a stationary control and regulating apparatus, preferably wirelessly via radio waves.

Other features which are considered as characteristic for the invention are set forth in the appended claims.

Although the invention is illustrated and described herein as embodied in an apparatus for conveying a sheet through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
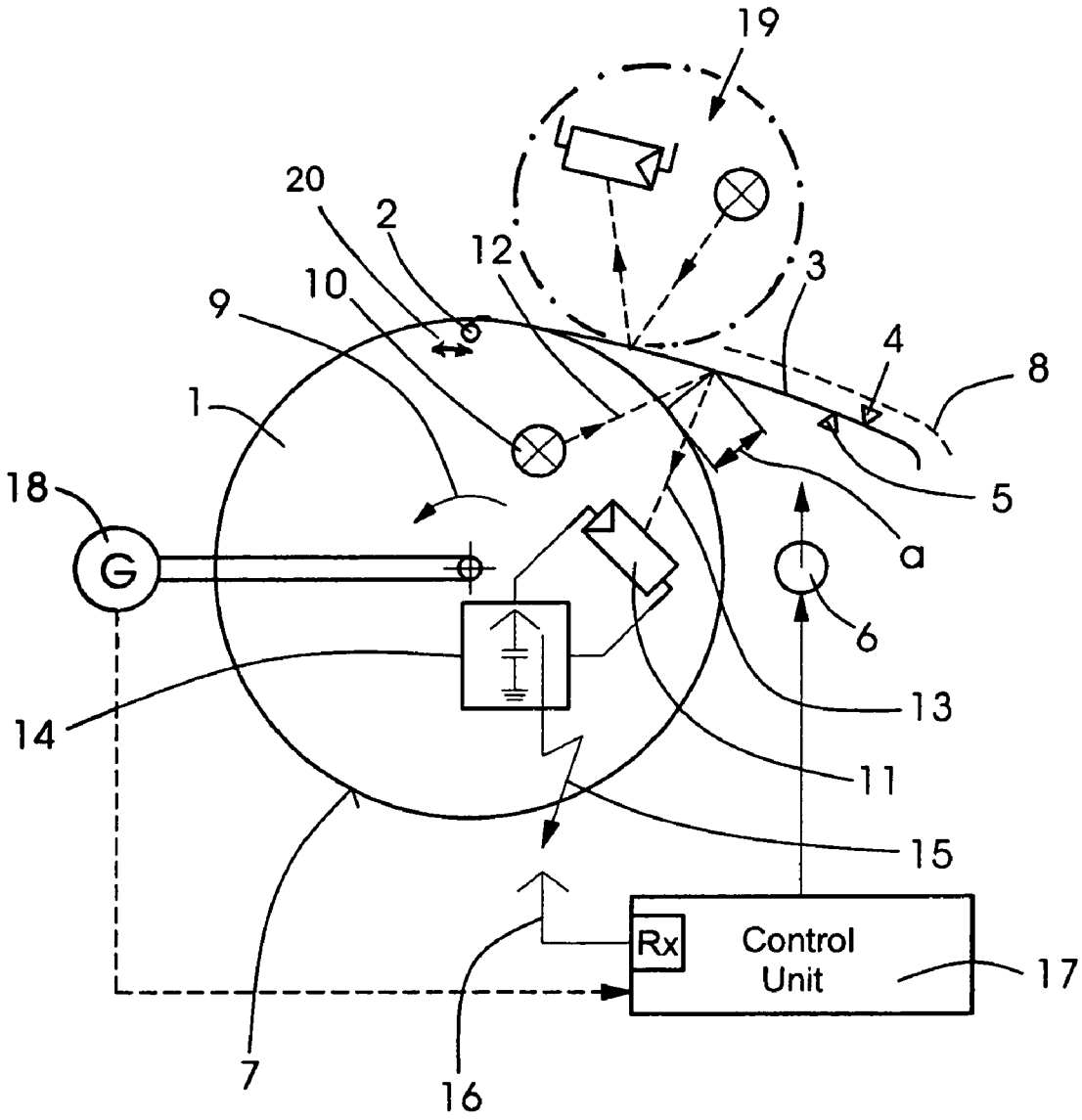
FIG. 1 is a diagrammatic view of a sheet conveying drum with an integrated sensor according to the invention.

Referring now to the figures of the drawing in detail, there is shown a drum of a sheet-fed press, or printing machine. The drum 1 has a gripper system 2, wherein a freshly printed sheet 3 is held. The sheet 3 has prints 4, 5 on both sides and it is held at a spacing distance from the periphery, or circumferential surface 7 and from guide plates 8 during conveying by way of a blast air and vacuum apparatus 6. The drum 1 is driven in the direction of the arrow 9, either directly by a motor, or via a gear mechanism. A light source 10 and a light receiver 11 are disposed on the drum 1. The light source 10 and the light receiver 11 together form a measurement configuration that is a constituent part of a distance sensor which measures according to the triangulation principle. The light source 10 emits light beams 12 in the direction of the sheet 3. The light beams 13 which are reflected from the sheet 3 strike the light receiver 11. The light receiver 11 comprises an evaluating apparatus for the light signals. The light receiver 11 forms measured signals which represent a distance a of the sheet 3 from the peripheral surface 7. The light receiver 11 is connected to a transmitter 14 which likewise circulates with the drum 1. The transmitter 14 generates high frequency oscillations 15 which are modulated with the measured distance signals. The modulated high frequency oscillations 15 are emitted via an antenna of the transmitter 14 and received by an antenna 16 of a receiver Rx which is a constituent part of a control and regulating apparatus 17—control unit 17, for short.

After demodulation, the demodulated measured distance signals are processed in the control and regulating apparatus 17 together with signals from a rotary encoder 18 which is coupled to the rotation of the drum 1. If the distance a deviates from a setpoint value at a defined rotational angle of the drum 1, then the control and regulating apparatus 17 generates signals for the blast air and vacuum apparatus 6. The blast air and vacuum apparatus 6 generates a force action on the sheet 3, with the result that the distance deviations are compensated for. In this way, the distance a can be regulated throughout the time wherein the sheet 3 is held in the gripper system 2.

If the sheet 3 is lost during conveying, no reflected light beams 13 pass to the light receiver 11. The signal which results in the process at the light receiver 11 in a predefined rotational angle range of the drum 1 can be used for the purpose of generating a missing sheet signal and/or bringing the conveying of the sheets 3 to a standstill. The light source 10, the light receiver 11 and the transmitter 14 are supplied by a current supply means which circulates with the drum 1 or which is arranged in a stationary position and supplies operating current by means of a rotary transmitter or via radio waves.

Figure 2:
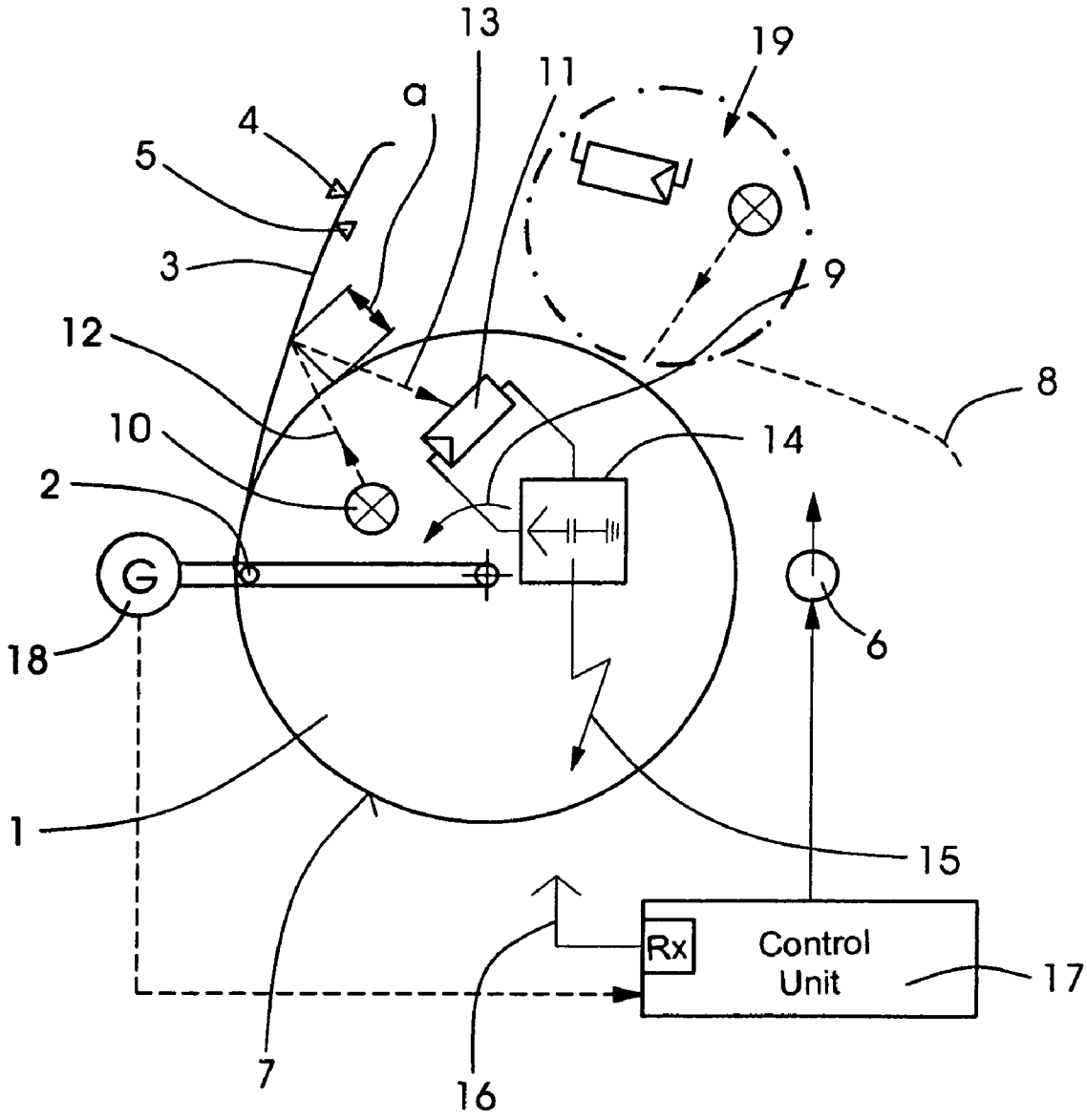
FIG. 2 is a similar view showing the drum of FIG. 1 in a further rotational position.

In order to describe the advantage of a distance sensor 10, 11 which circulates with the drum 1, an optical triangulation sensor 19 which is fixed to the frame is also shown in FIGS. 1 and 2, as is used in solutions according to the prior art. Compared with FIG. 1, the drum 1 in FIG. 2 has been rotated further by approximately 90 degrees. As is apparent from FIG. 2, the sheet 3 is situated outside the detection range of the triangulation sensor 19, while the circulating sensor 10, 11 according to the invention can still supply distance signals.

The position of the sheet 2 may be adjusted by moving the grippers forward or rearward. For that purpose, there is provided a device 20 for moving the grippers (2) in a circumferential direction 9 of the drum 1.

This application claims the priority, under 35 U.S.C. § 119, of German patent application 10 2005 005 571.0 of Feb. 7, 2005; the foreign application is herewith incorporated by reference in its entirety.

We claim:

1. An apparatus for conveying a sheet through a printing machine, comprising:

a circulating conveyor element having grippers for holding the sheet at a leading edge thereof;

a device for setting a position of the sheet with regard to a desired position;

a measuring configuration disposed to circulate with said circulating conveyor element for measuring a position of the sheet;

a rotatable drum, said conveyor element being fastened to said rotatable drum, and said measuring configuration being directed onto the sheet at a location following said grippers in a conveying direction, said measuring configuration being configured to measure a distance of the sheet from a surface of said rotatable drum; and a control device connected to said device for setting the position and to said measuring configuration.

2. The apparatus according to claim 1, wherein said measuring configuration comprises a light source disposed to direct light beams onto the sheet1 and a light receiver for receiving light beams reflected from the sheet.

3. The apparatus according to claim 1, wherein said measuring configuration comprises an ultrasound source disposed to direct ultrasound waves onto the sheet, and an ultrasound receiver for receiving ultrasound waves reflected from the sheet.

4. The apparatus according to claim 1, wherein said control device is a stationary control device and said measuring configuration is connected wirelessly to said stationary control device.

5. The apparatus according to claim 1, which wherein said rotatable drum has a surface, and said measuring configuration is configured to measure the position of the sheet on the surface of the rotating drum.

6. The apparatus according to claim 1, wherein said measuring configuration comprises a plurality of sensors disposed at different positions of said rotatable drum.

7. The apparatus according to claim 1, wherein said device for setting the position of the sheet comprises a blast air apparatus.

8. The apparatus according to claim 1, wherein, said conveyor element are grippers fastened to said rotatable drum, and said device for setting the position of the sheet comprises a device for moving said grippers in a circumferential direction of said drum.

* * * * *